US007370625B2

(12) United States Patent
Hanafusa

(10) Patent No.: US 7,370,625 B2
(45) Date of Patent: May 13, 2008

(54) ENGINE ACCESSORY LAYOUT STRUCTURE FOR VEHICLE

(75) Inventor: Seiji Hanafusa, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 141 days.

(21) Appl. No.: 11/473,269

(22) Filed: Jun. 23, 2006

(65) Prior Publication Data

US 2006/0288975 A1 Dec. 28, 2006

(30) Foreign Application Priority Data

Jun. 28, 2005 (JP) ..... 2005-188378

(51) Int. Cl.
*F02B 61/04* (2006.01)
*F02B 77/04* (2006.01)

(52) U.S. Cl. ..... 123/198 R; 123/198 E

(58) Field of Classification Search ..... 123/198 R, 123/198 E
See application file for complete search history.

(56) References Cited

FOREIGN PATENT DOCUMENTS

JP 9-328088 A 12/1997

*Primary Examiner*—Noah P. Kamen
(74) *Attorney, Agent, or Firm*—Birch, Stewart, Kolasch & Birch, LLP

(57) ABSTRACT

An engine accessory layout structure for a vehicle by which engine accessories are laid out near the engine without trouble. The structure includes a throttle valve disposed in the periphery of an engine, and an engine accessory laid out at an upper portion of an engine and a lower portion of a seat. A heat guard is provided which is disposed on the upper side of the engine so as to separate the engine and a fuel piping from each other. The engine accessory is mounted onto an upper portion of the heat guard. The heat guard also protects the throttle valve.

20 Claims, 6 Drawing Sheets

ENGINE ACCESSORY LAYOUT STRUCTURE FOR VEHICLE

CROSS-REFERENCE TO RELATED APPLICATION

The present application claims priority under 35 U.S.C. §119 to Japanese Patent Application No. 2005-188378, filed Jun. 28, 2005, the entire contents of which are hereby incorporated by reference.

BACKGROUND OF THE INVENTION

1. Field of the Invention

The present invention relates to an engine accessory layout structure for an all terrain vehicle, such as a four-wheel buggy car designed for operation on an unconditioned ground.

2. Description of Background Art

As an example of a conventional engine accessory layout structure for a vehicle, the engine accessories such as a regulator, an igniter, an ignition coil, etc. are stored in a box-shaped space disposed in a front fender on the front side of a fuel tank (see, for example, Japanese Patent Laid-open No. Hei 09-328088).

In Japanese Patent Laid-open No. Hei 09-328088, however, in the ignition coil of the engine accessories, a plug cord on the secondary side is electrically connected to a spark plug screwed into a cylinder head, so that the plug cord is extended over a long distance from a box-shaped space on the front side of the fuel tank to the cylinder head. As a result, means for preventing influences of noise generated by the high voltage on other engine accessories and preventing leakage of the noise need to be additionally provided.

SUMMARY AND OBJECTS OF THE INVENTION

It is an object of the present invention to solve the above-mentioned problem and to provide an engine accessory layout structure for vehicle by which engine accessories can be laid out in the vicinity of an engine without any trouble.

In order to attain the above object, according to a first aspect of the present invention, an engine accessory layout structure for a vehicle includes a throttle valve disposed in the periphery of an engine; and an engine accessory disposed at a upper side of the engine and a lower side of a seat. In the engine accessory layout structure, a heat guard is provided which is disposed on the upper side of the engine so as to separate the engine and a fuel piping from each other, to protect the throttle valve, and to mount the engine accessory onto an upper portion thereof.

According to a second aspect of the present invention, so that the engine accessory is an ignition coil for generating a high voltage, the fuel piping is a high-pressure piping for supplying a fuel to an injector of the engine, and the heat guard includes a separating extension plate for separating a wiring for the ignition coil and the high-pressure piping from each other.

According to the engine accessory layout structure for a vehicle as set forth in the first aspect of the present invention, the heat guard is disposed on the upper side of the engine so as to separate the engine and the fuel piping from each other, whereby radiant heat from the engine is prevented from being given to the fuel piping. In addition, with the heat guard disposed on the upper side of the engine, the throttle vale can be protected so that mud or dust would not come into contact with the throttle valve, and the throttle valve can be protected so that a hook of the seat or the like would not interfere with the throttle valve during an operation of mounting or dismounting the seat. Further, with the engine accessory mounted onto an upper portion of the heat guard, the engine accessory can be disposed near the engine in the state of being protected from the radiant heat of the engine, and the distance from the engine accessory to the engine can be shortened. Accordingly, the engine accessory can be disposed near the engine without using a mounting stay or the like for exclusive use and without any trouble, effective utilization of the space at an upper portion of the engine can be contrived, and the design of the vehicle can be enhanced.

According to the second aspect of the present invention, the separating extension plate of the heat guard ensures that the plug cord on which a high secondary voltage is impressed in the ignition coil can be laid out independently from the high-pressure piping through which the fuel flows. As a result, the wiring for the ignition coil and the high-pressure piping can be separated from each other, the noise generated from the plug cord can be prevented from adversely influencing other engine accessories or from leaking to produce bad effects, and the quality of the vehicle can be insured.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
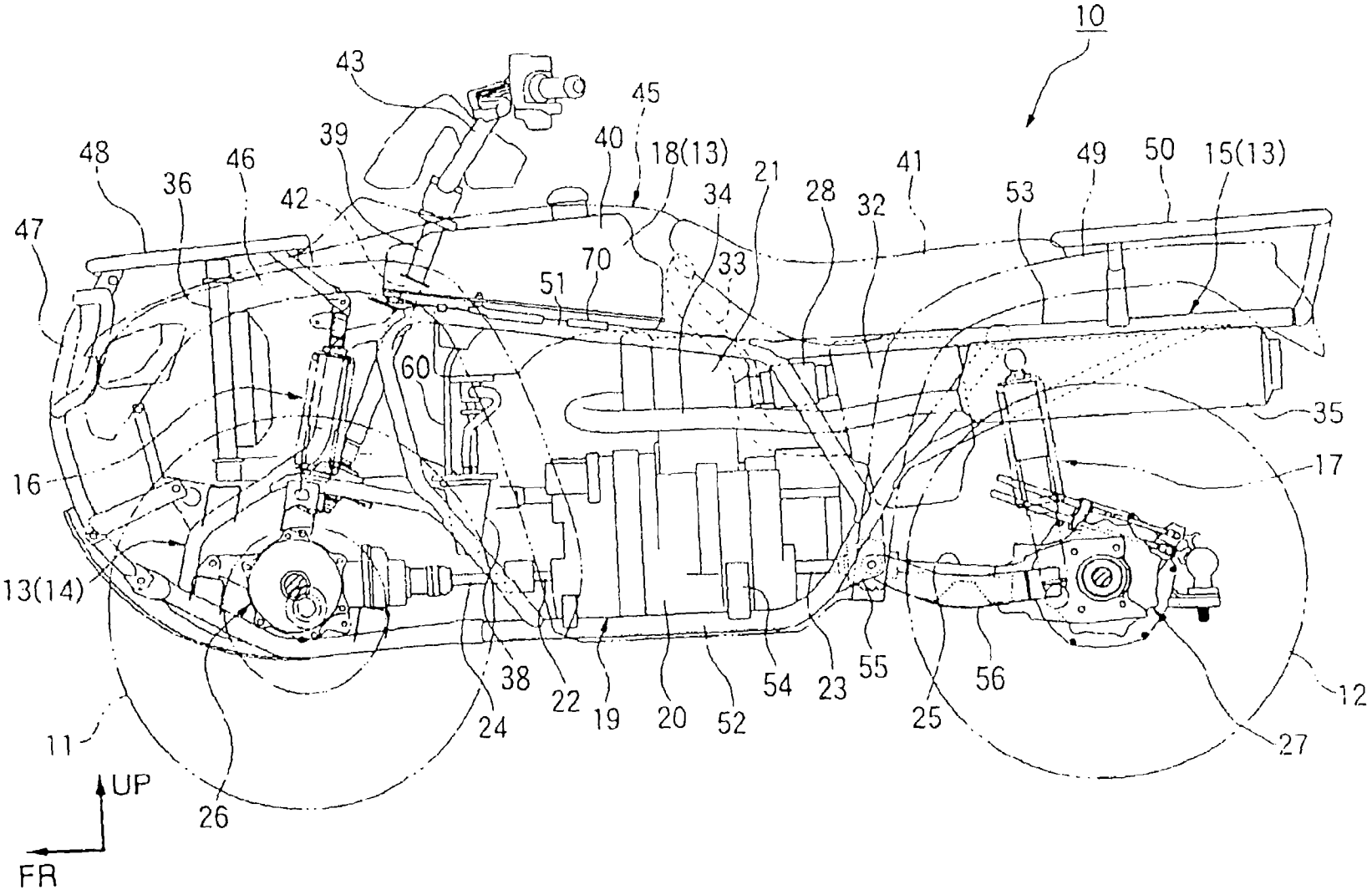
FIG. 1 is a side view of a vehicle on which an embodiment of the engine accessory layout structure for vehicle according to the present invention is mounted.

Incidentally, the front, rear, leftward, rightward and the like directions in the following description are the same as the directions in the vehicle, unless otherwise specified. Besides, arrow FR in the drawings indicates the vehicle forward direction, arrow LH indicates the vehicle leftward direction, and arrow UP indicates the vehicle upward direction.

Figure 2:
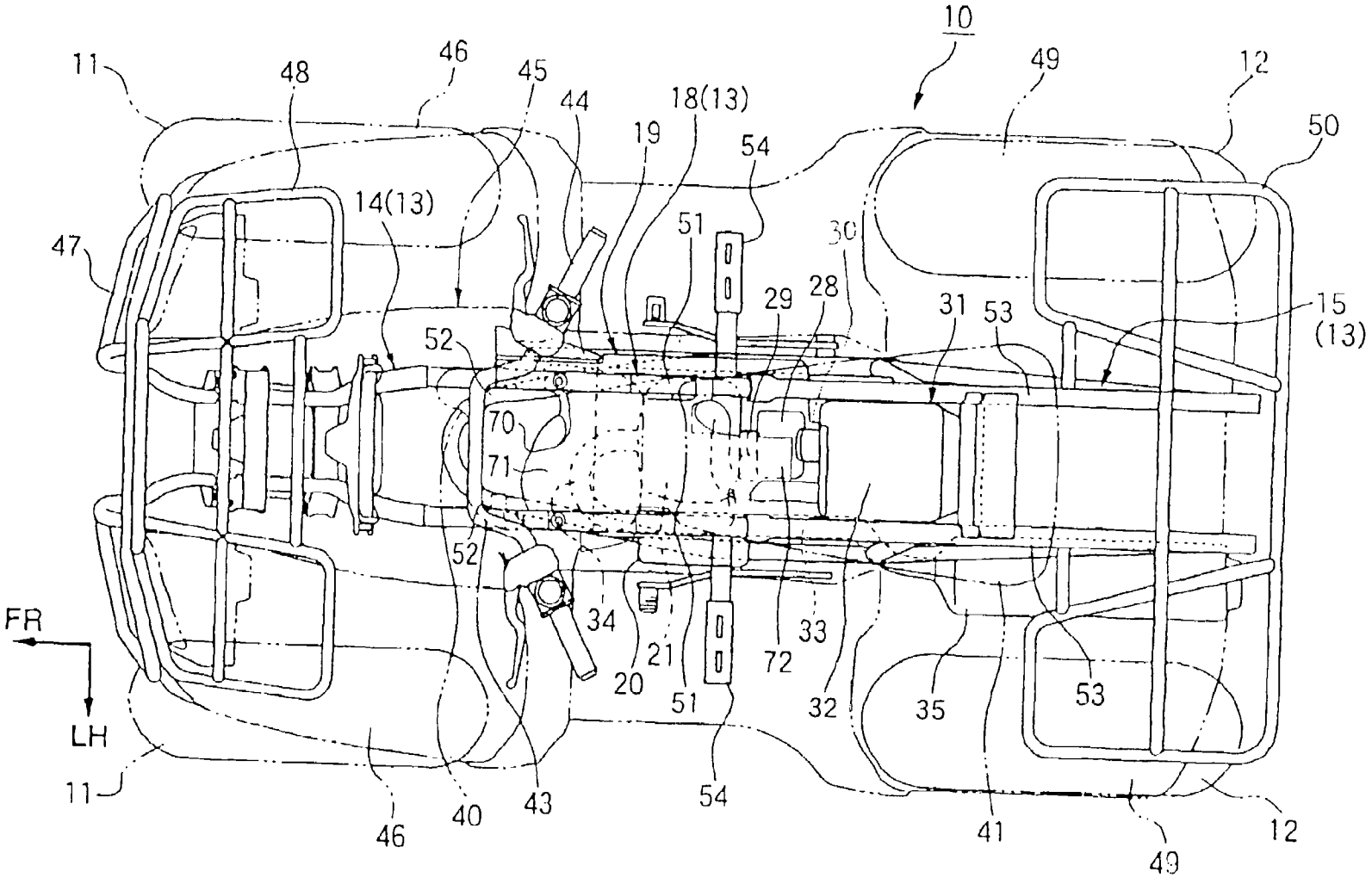
FIG. 2 is a plan view of the vehicle shown in FIG. 1.

As shown in FIGS. 1 and 2, the vehicle 10 on which the engine accessory layout structure for vehicle is mounted is an all terrain vehicle, i.e., so-called ATV, having a configuration wherein left and right front wheels 11 and rear wheels 12 composed of comparatively large diameter low-pressure balloon tires are provided on the front and rear sides of a vehicle body structured to be small in size and light in weight, whereby the ground clearance is sufficiently secured and the performance of running mainly on unconditioned grounds is enhanced. The front wheels 11 and the rear wheels 12 are suspended in a front frame 14 and a rear frame 15 provided in a vehicle body frame 13, through front suspensions 16 and rear suspensions 17

An engine 19 as a prime mover is mounted on a center frame 18 disposed at a roughly central portion of a vehicle body in the vehicle body frame 13. The engine 19 is, for example, a water-cooled type single-cylinder reciprocating engine, and is set in a longitudinal layout in which the rotational axis of a crankshaft is laid along the vehicle front-rear direction. The engine 19 has a configuration in which a cylinder head 21 is set upright on a crankcase 20, and a front-side output shaft 22 and a rear-side output shaft 23 are led out respectively forward and rearward in the front-rear direction, from portions set off to the rear side from the center in the vehicle left-right direction at front and rear portions of the crankcase 20.

The output shafts 22 and 23 are connected to the front wheels 11 and the rear wheels 12 through a front propeller shaft 24 and a rear propeller shaft 25 and through a front final reduction gear unit 26 and a rear final reduction gear unit 27, respectively. Therefore, the output from the engine 19 is transmitted through a transmission (not shown) contained in the crankcase 20 and then transmitted from the output shafts 22, 23 to the front wheels 11 and the rear wheels 12 through drive shafts 24, 25 and the final reduction gear units 26, 27, respectively.

A throttle valve 28 is connected to a rear portion of the cylinder head 21 of the engine 19 through an intake manifold 29, and a rear portion of the throttle valve 28 is communicatingly connected to an air cleaner 31 through a connecting tube (10). A snorkel duct 33 is communicatingly connected to an air cleaner case 32 of the air cleaner 31. The snorkel duct 33 is opened at an upper portion of the vehicle body where the influence of the radiant heat of the engine 19 is absent. A temperature sensor (not shown) is attached to the air cleaner case 32.

In addition, an exhaust pipe 34 is connected to a front portion of the cylinder head 21 through an exhaust manifold (not shown). The exhaust pipe 34 extends to the front side of the cylinder head 21, is then turned back, and extends rearward while passing on the left side of the cylinder head 21, and a tip end portion thereof is communicatingly connected to a muffler 35 disposed at a rear portion of the vehicle body. Incidentally, a radiator 36 for cooling the engine 19 is disposed on the front side of the front suspensions 16, and a fuel pump 38 for feeding a fuel under a high pressure into an injector (see FIG. 6) 37 is disposed on the front side of the engine 19.

In addition, at a central portion in the left-right direction of the vehicle body, a steering shaft 39, a fuel tank 40, and a saddle type seat 41 are laid out in this order from the front side. A lower end portion of the steering shaft 39 is connected to a front wheel steering mechanism (not shown) through a head pipe 42 disposed near the front end of the front frame 14, and a steering handle 43 is attached to an upper end portion of the steering shaft 39. Incidentally, an accelerator mechanism (not shown) connected to the throttle valve 28 receives reactional forces from the front, rear, left and right sides during running of the vehicle 10; for easier control of the vehicle, therefore, the accelerator mechanism is not incorporated in a turnable grip, such as a right grip 40, but is independently provided in other place.

A resin-made vehicle body cover 45 for covering a front portion of the vehicle body, a resin-made front fender 46 for covering the front wheels 11 on the upper and rear sides of the latter, a front protector 47 formed mainly of steel members, and a front carrier 48 are mounted on a front portion of the vehicle body frame 13. In addition, a resin-made rear fender 49 for covering the rear wheels 12 on the upper and front sides of the latter, and a rear carrier 50 formed mainly of steel members are mounted on a rear portion of the vehicle body frame 13.

The vehicle body frame 13 is produced by integrally connecting a plurality of kinds of steel members by welding or the like, in which closed loop structures are formed by use of left and right upper pipes 51 and lower pipes 52, and the closed loop structures are connected to each other through a plurality of cross members to form a box structure elongate in the front-rear direction, at a central portion in the left-right direction of the vehicle body.

Each of the upper pipes 51 is slightly inclined rearwardly downward on the outside of an upper portion of the vehicle body frame 13, and is connected at its rear portion to the lower pipe 52 disposed substantially horizontally on the outside of a lower portion of the vehicle body frame 13. Each of the upper pipe 51 is connected at its rear portion to each seat frame 53, and left and right steps 54 are fixed to central portions of the lower pipes 52.

In addition, left and right swing arm support portions 55 having a roughly triangular shape flat in the front-rear direction are integrally provided at rear lower portions of the upper pipes 51, and a swing arm 56 to which the rear final reduction gear unit 27 is fixed is turnably connected to each of the swing arm support portion 55.

A heat guard 70 is mounted onto the upper pipes 51. The heat guard 70 is located on the upper side of the engine 19 and the throttle valve 28 and on the lower side of the fuel tank 40.

Figure 3:
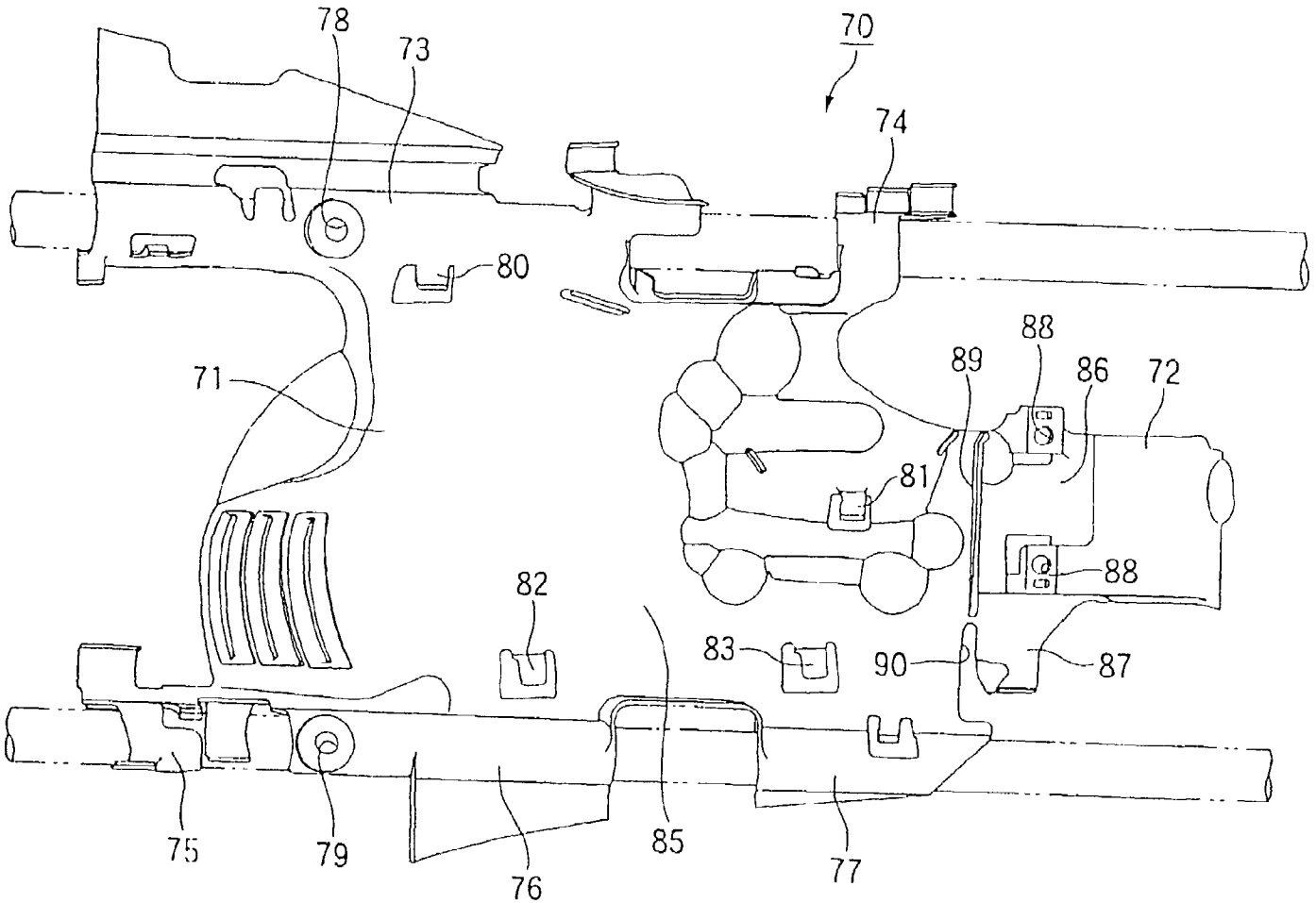
FIG. 3 is a plan view of a heat guard used in the vehicle shown in FIG. 1.
Figure 4:
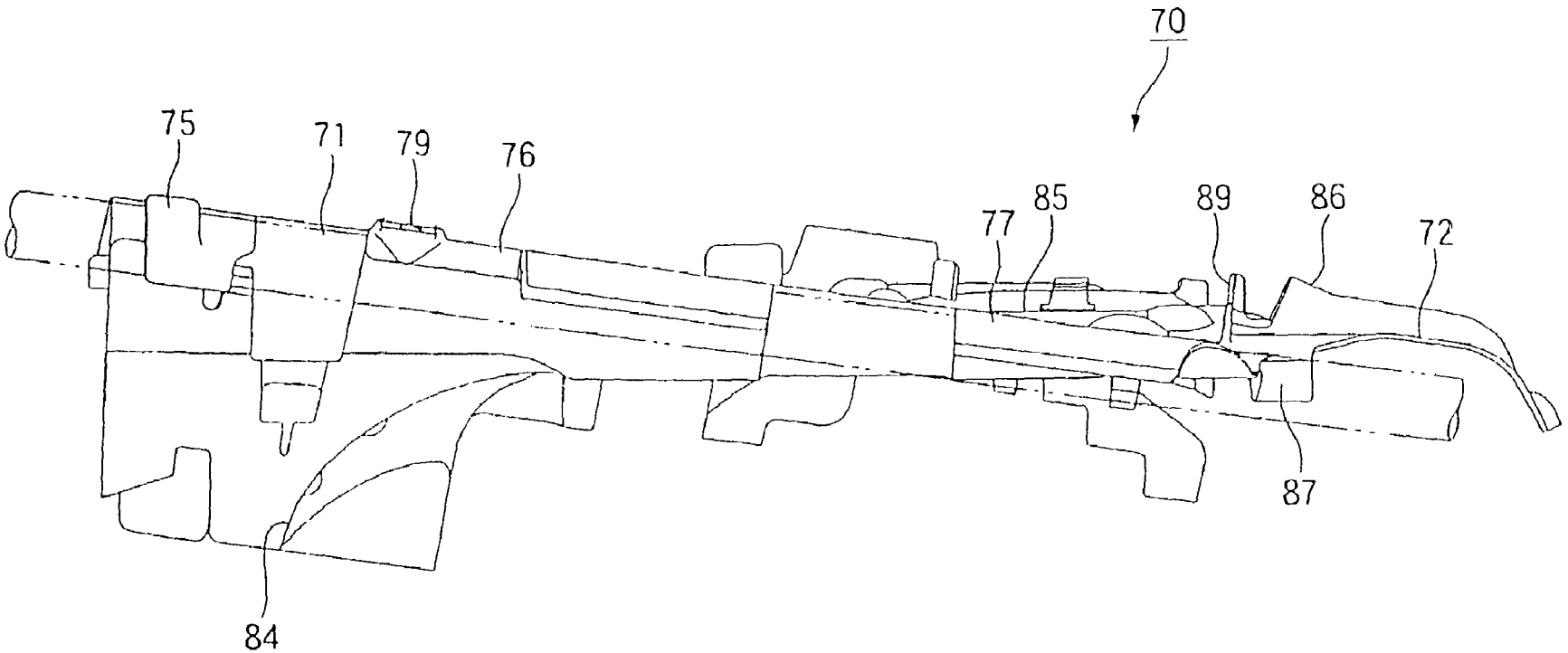
FIG. 4 is a side view of the heat guard shown in FIG. 3.
Figure 5:
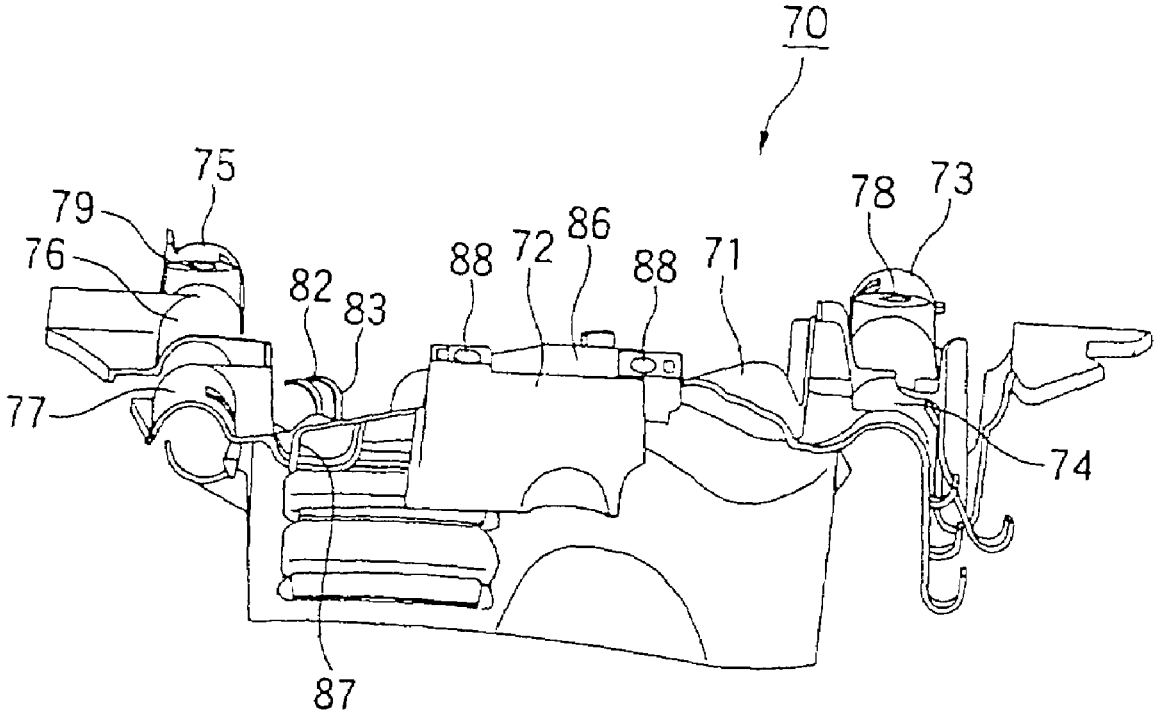
FIG. 5 is a back elevation of the heat guard shown in FIG. 3.

As shown in FIGS. 3 to 5, the heat guard 70 is composed mainly of a main body 71, and a separating extension plate 72. The heat guard 70 is formed in a predetermined thickness, from a resin which shields and does not absorb heat.

The main body 71 is a plate member bridging between the left and right upper pipes 51. The main body 71 is provided on the right sides with first and second fixing portions 73 and 74 formed in semi-cylindrical shapes and disposed at an interval along the upper pipe 51, and is provided on the left side with third, fourth and fifth fixing portions 75, 76 and 77 formed in semi-cylindrical shapes and disposed at intervals along the upper pipe 51. The first and second fixing portions 73 and 74 are put on the right-side upper pipe 51 from above, while the third, fourth and fifth fixing portions 75, 76 and 77 are put on the left-side upper pipe 51 from above, and the fixing portions are fixed to the upper pipes 51 by, for example, bolts or the like. The first and fourth fixing portions 73 and 76 are provided with fuel tank fixing bolt holes 78 and 79 at positions near the front ends thereof.

Besides, the main body 71 is provided, on the right side on the side of the first and second fixing portions 73 and 74, with two wire harness hook portions 80 and 81 arranged along the tube direction of the upper pipes 51, and is provided, on the left side on the side of the third, fourth and fifth fixing portions 75, 76 and 77, with two fuel pipe hook portions 82 and 83 arranged along the tube direction of the upper pipes 51. The main body 71 is provided, on the front side of the fuel pipe hook portion 82, a fuel pipe leading-out guide portion 84 curved downward toward the fuel pump 38 provided on the lower side of the fuel tank 40.

The separating extension plate 72 is extended in a tetragonal plate-like shape toward the rear side of the main body 71, wherein the heat guard includes a main body The ignition coil mounting portion 86 is provided with screw holes 88 in both end portions thereof, and is provided on the main body 71 side with a partition plate 89 erected for partition between the ignition coil mounting portion 86 and the main body 71. The separating tongue piece 87 is projected leftward from an end portion of the ignition coil mounting portion 86 via a notch 90, and is bent to the lower side.

Figure 6:
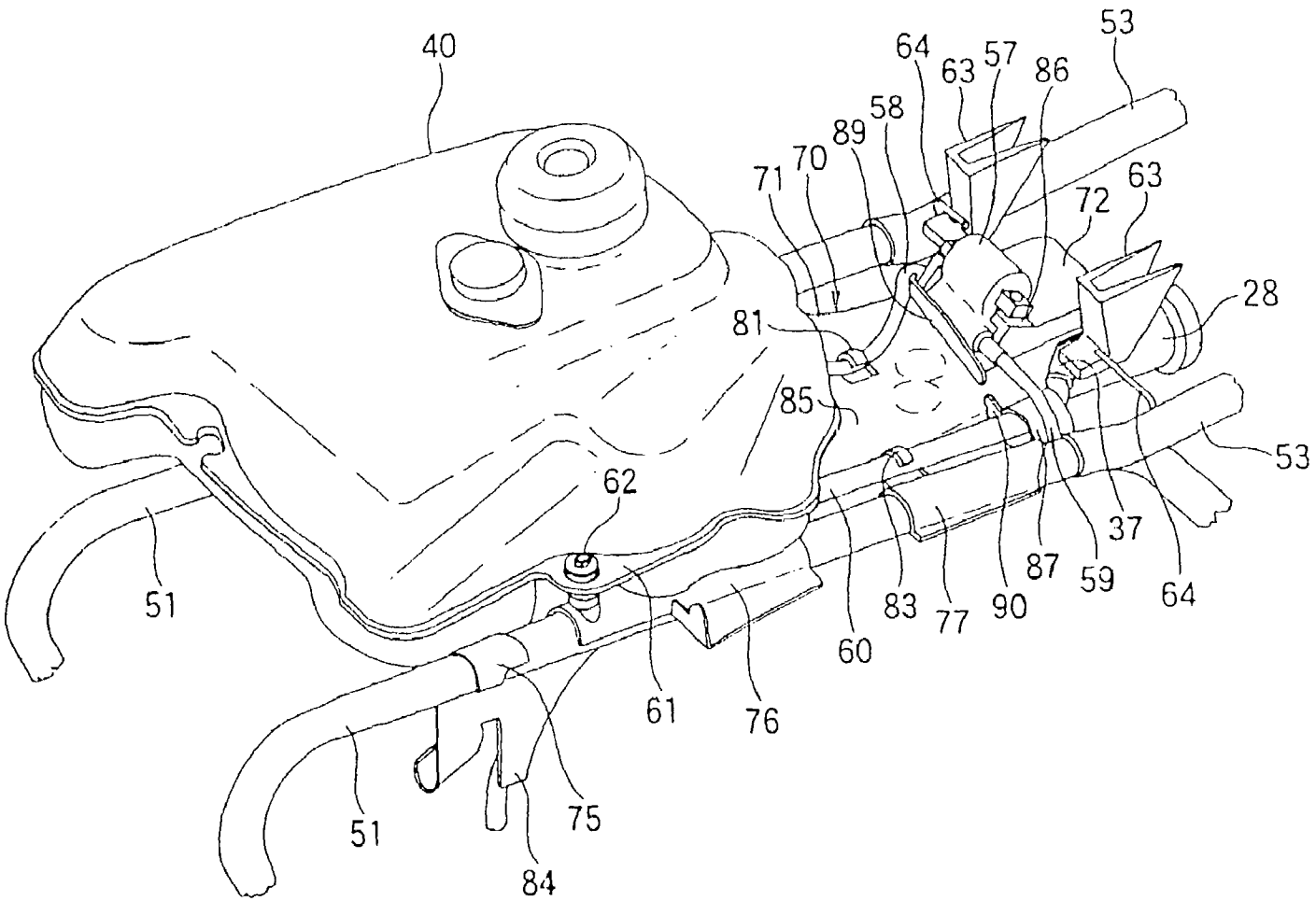
FIG. 6 is a partly broken perspective view for illustrating the condition where the heat guard shown in FIG. 3 is mounted onto a vehicle body.

As shown in FIG. 6, the heat guard 70 is disposed at an upper side of the engine (see FIG. 1) 19 by a method wherein the first and second fixing portions 73 and 74 are put on and fixed from above to the right-side upper pipe 51, and the third, fourth and fifth fixing portions 75, 76 and 77 are put on and fixed from above to the left-side upper pipe 51.

With the heat guard 70 bridging between on the upper pipes 51 and fixed to the latter, the separating extension plate 72 is so disposed as to cover an upper portion of the throttle valve 28. Besides, with the ignition coil 57 bolted to the ignition coil mounting portion 86 of the separating extension plate 72, the ignition coil 57 is disposed in the state of being partitioned from the main body 71 by the partition plate 89.

In this case, a branch wiring (not shown) branched from a wire harness 58 hooked sequentially on the wiring harness hook portions 80 and 81 in the direction from the front side toward the rear side on the main body 71 is electrically connected to the primary side of the ignition coil 57.

A plug cord 59 electrically connected to a spark plug (not shown) screwed into the cylinder head 21 is connected to the secondary side of the ignition coil 57. Here, the plug cord 59 is extended leftward from the ignition coil mounting portion 87, and is led out downwards along the separating tongue piece 87 of the separating extension plate 72.

In addition, a fuel piping 60 led out upward from the fuel pump (see FIG. 1) 38 is led out from the fuel pipe leading-out guide portion 84 onto the upper surface 85 of the main body 71, is hooked on the fuel pipe hook portions 82 and 83 sequentially along the direction from the front side toward the rear side, is then led out to the lower side of the separating tongue piece 87 of the separating extension plate 72, and is communicatingly connected to the injector 37.

Here, the fuel piping 60 is disposed on the main body 71 of the heat guard 70, whereby the fuel piping 60 is passed through a place remote from the engine 19 to reach the injector 37; therefore, the fuel piping 60 does not receive the radiant heat of the engine 19, and is communicated with the injector 37 without being bent by the fuel pipe leading-out guide portion 84 and the fuel pipe hook portions 82, 83.

Thus, the plug cord 59 is laid out on the upper surface of the separating tongue piece 87 of the separating extension plate 72, and the fuel piping 60 is laid out on the lower surface of the separating tongue piece 87, so that the plug cord 59 to which a high secondary voltage (current) of the ignition coil 57 is applied (supplied) can be laid out independently from the fuel piping 60 through which the fuel flows. Therefore, the plug cord 59 and the fuel piping 60 can be separated from each other with a simple structure.

The fuel tank 40 is mounted onto the front side of the main body 71 through the fuel tank fixing bolt holes 78, 79 in the first and third fixing portions 73, 75 of the heat guard 70. In this case, the fuel tank 40 is mounted onto the upper pipes 51 so as not to receive vibrations of the vehicle body, by a structure in which a damper bolt 62 is inserted in, for example, a metallic base 61 formed integrally with a central portion of the fuel tank 40, and the damper bolt 61 is screwed into the fuel tank fixing bolt holes 78, 79 in the first and fourth fixing portions 73, 76.

The saddle type seat (see FIG. 1) 41 is disposed on the rear side of the main body 71 of the heat guard 70 and on the separating extension plate 72. In this case, attachment and detachment of seat-side hooks 63, 63 of the saddle type seat 41 are conducted through a pair of vehicle body-side hooks 64, 64 disposed between the upper pipes 51. The vehicle body-side hook 64 is fixed to the seat frame 53, while the seat-side hook 63 is attached to the back side of the saddle type seat 41 so as to be turnable by a spring bias. Therefore, since the separating extension plate 72 is so disposed as to cover the throttle valve 28 and the injector 37, the seat-side hooks 63, 63 on the saddle type seat 41 side to be locked on the vehicle-side hooks 64, 64 do not interfere with the throttle valve 28 and the injector 37 during an attaching or detaching operation, so that the throttle valve 28 and the injector 37 are prevented from being damaged by a tool used in the operation or the like.

Incidentally, in addition to the ignition coil 57 shown in the drawing, other engine accessories such as a regulator, an igniter, etc. may be laid out on the main body 71 and the separating extension plate 72 of the heat guard 70.

In the engine accessory layout structure for the vehicle 10 according to one embodiment of the present invention as above-described, the heat guard 70 is disposed on the upper side of the engine 19 so as to separate the engine 19 and the fuel piping 60 from each other, whereby the radiant heat of the engine 19 is not given to the fuel piping 60. In addition, with the heat guard 70 disposed on the upper side of the engine 19, the throttle valve 28 and the injector 37 can be so protected that mud or dust would not come into contact therewith, and the throttle valve 28 and the injector 37 can be so protected that the hooks of the saddle type seat 41 would not interfere therewith during an operation of mounting or dismounting the saddle type seat 41. Besides, with the ignition coil 57 attached to an upper portion of the heat guard 70, the ignition coil 57 can be laid out near the engine 19 in the state of being protected from the radiant heat of the engine 19, and the distance from the ignition coil 57 to the engine 19 can be shortened. This makes it possible to lay out the ignition coil 57 near the engine 19 without any trouble, to provide more effective use of the space at an upper portion of the engine 19, and to enhance the design of the vehicle 10.

In addition, in the engine accessory layout structure for the vehicle 10 according to this embodiment, the plug cord 59 on which a high secondary voltage is impressed in the ignition coil 57 can be laid out independently from the fuel piping 60 through which the fuel flows, due to the presence of the separating extension plate 72 of the heat guard 70. As a result, the plug cord 59 of the ignition coil 57 and the fuel piping 60 can be separated from each other with a simple structure, the noise generated from the plug cord 59 can be prevented from adversely influencing other engine accessories or leaking to produce bad influences, and the quality of the vehicle 10 can be insured.

In addition, in the engine accessory layout structure for the vehicle 10 according to this embodiment, since the vehicle 10 is an ATV, the high quality of the vehicle can be maintained for a long time even when the vehicle is used in a severe conditions such as running on unconditioned grounds, since the ignition coil 57 is laid out to be free of troubles.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine accessory layout structure for a vehicle, comprising:

a throttle valve disposed in a periphery of an engine;

an engine accessory disposed at a upper side of said engine and a lower side of a seat; and a heat guard disposed on an upper side of said engine so as to separate said engine and a fuel piping from each other, to protect said throttle valve, and to mount said engine accessory onto an upper portion thereof.

2. The engine accessory layout structure of the vehicle as set forth in claim 1, wherein said engine accessory is an ignition coil for generating a high voltage, said fuel piping is a high-pressure piping for supplying a fuel to an injector of said engine, and said heat guard includes a separating extension plate for separating a wiring for said ignition coil and said high-pressure piping from each other.

3. The engine accessory layout structure of the vehicle as set forth in claim 2, wherein the separating extension plate extends in a tetragonal plate-shape toward a rear side of a main body of the heat guard.

4. The engine accessory layout structure of the vehicle as set forth in claim 2, wherein the separating extension plate is provided with an ignition coil mounting portion and a separating tongue piece on a lateral side of the ignition coil mounting portion.

5. The engine accessory layout structure of the vehicle as set forth in claim 4, wherein the separating tongue piece of the separating extension plate separates the wiring for the ignition coil from the high-pressure fuel piping.

6. The engine accessory layout structure of the vehicle as set forth in claim 2, wherein the fuel piping extends upwardly from a fuel pump onto an upper surface of a main body of the heat guard, then extends rearwardly to a lower side of a separating tongue piece of the separating extension plate, and then connects to the injector.

7. The engine accessory layout structure of the vehicle as set forth in claim 2, wherein the wiring extends in a lateral direction from the ignition coil, then extends downwardly along a separating tongue piece of the separating extension plate, and then connects to a spark plug of the engine.

8. The engine accessory layout structure of the vehicle as set forth in claim 1, wherein the heat guard is formed of a resin for minimizing absorption of heat.

9. The engine accessory layout structure of the vehicle as set forth in claim 1, wherein the heat guard includes a main body mounted onto a pair of upper pipes in a position under a fuel tank.

10. The engine accessory layout structure of the vehicle as set forth in claim 1, wherein the heat guard includes a main body and a separating extension plate disposed rearwardly of the main body, the separating extension plate including an engine accessory mounting portion formed with a partition plate for separating the engine accessory from the main body.

11. An engine accessory layout structure for a vehicle, comprising:

a throttle valve disposed adjacent to a rear side of an engine;

an engine accessory disposed at a upper side of the engine and a lower side of a seat; and a heat guard disposed on an upper side of said engine for separating the engine and a fuel piping from each other, and for protecting the throttle valve from above, wherein the engine accessory is mounted on an upper portion of the heat guard.

12. The engine accessory layout structure of the vehicle as set forth in claim 11, wherein the engine accessory is an ignition coil for generating a high voltage, the fuel piping is a high-pressure piping for supplying a fuel to an injector of the engine, and the heat guard includes a separating extension plate for separating a wiring for the ignition coil and the high-pressure piping from each other.

13. The engine accessory layout structure of the vehicle as set forth in claim 12, wherein the separating extension plate extends in a tetragonal plate-shape toward a rear side of a main body of the heat guard.

14. The engine accessory layout structure of the vehicle as set forth in claim 12, wherein the separating extension plate is provided with an ignition coil mounting portion and a separating tongue piece on a lateral side of the ignition coil mounting portion.

15. The engine accessory layout structure of the vehicle as set forth in claim 14, wherein the separating tongue piece of the separating extension plate separates the wiring for the ignition coil from the high-pressure fuel piping.

16. The engine accessory layout structure of the vehicle as set forth in claim 12, wherein the fuel piping extends upwardly from a fuel pump onto an upper surface of a main body of the heat guard, then extends rearwardly to a lower side of a separating tongue piece of the separating extension plate, and then connects to the injector.

17. The engine accessory layout structure of the vehicle as set forth in claim 12, wherein the wiring extends in a lateral direction from the ignition coil, then extends downwardly along a separating tongue piece of the separating extension plate, and then connects to a spark plug of the engine.

18. The engine accessory layout structure of the vehicle as set forth in claim 11, wherein the heat guard is formed of a resin for minimizing absorption of heat.

19. The engine accessory layout structure of the vehicle as set forth in claim 11, wherein the heat guard includes a main body mounted onto a pair of upper pipes in a position under a fuel tank.

20. The engine accessory layout structure of the vehicle as set forth in claim 11, wherein the heat guard includes a main body and a separating extension plate disposed rearwardly of the main body, the separating extension plate including an engine accessory mounting portion formed with a partition plate for separating the engine accessory from the main body.

* * * * *